United States Patent [19]

Memminger et al.

[11] 4,271,687

[45] Jun. 9, 1981

[54] RAPID MAINTENANCE THREAD OR YARN SUPPLY APPARATUS, PARTICULARLY FOR CIRCULAR KNITTING MACHINES

[75] Inventors: Gustav Memminger, Freudenstadt; Falk Kühn, Kiebingen, both of Fed. Rep. of Germany

[73] Assignee: Memminger GmbH, Freudenstadt, Fed. Rep. of Germany

[21] Appl. No.: 929,996

[22] Filed: Aug. 1, 1978

[51] Int. Cl.[3] ..... D04B 15/44; D04B 35/14

[52] U.S. Cl. ..... 66/146; 66/132 T; 66/163; 242/47.01

[58] Field of Search ..... 66/125 R, 132 T, 132 R, 66/146, 158, 161, 163; 28/187; 242/47.01

[56] References Cited

U.S. PATENT DOCUMENTS

| | | | |
|---|---|---|---|
| 2,056,307 | 10/1936 | Wachsman | 66/163 |
| 2,172,128 | 9/1939 | Mitschele | 66/158 |
| 2,410,718 | 11/1946 | Crawford | 66/163 |
| 3,132,466 | 5/1964 | Preisser | 28/187 X |
| 3,820,731 | 6/1974 | Rosen | 242/47.01 X |
| 3,848,434 | 11/1974 | Hopkins | 66/163 |
| 3,867,592 | 2/1975 | Quellos | 66/163 X |
| 3,883,083 | 5/1975 | Rosen | 66/132 R X |
| 4,024,734 | 5/1977 | Jordan | 66/158 |
| 4,027,505 | 6/1977 | Mishcon et al. | 66/125 R |
| 4,028,911 | 6/1977 | Fecker et al. | 66/132 R |
| 4,056,239 | 11/1977 | Fecker et al. | 66/132 R X |
| 4,106,713 | 8/1978 | Jacobsson | 242/47.01 |
| 4,114,823 | 9/1978 | Fecker et al. | 66/132 R X |
| 4,153,213 | 5/1979 | Jacobsson | 242/47.01 |

*Primary Examiner*—Wm. Carter Reynolds

*Attorney, Agent, or Firm*—Frishauf, Holtz, Goodman & Woodward

[57] ABSTRACT

To permit ready disassembly of thread sensing and thread brake elements from a yarn feed device, the thread sensing, thread guiding and thread brake elements are, selectively, secured to a separate attachment or housing which is connected to the holder by means of a slidable shoe-socket arrangement which, additionally, carries the contacts for the stop-motion system of the machine so that, depending on yarn being used on the machine and supplied by the device, the supply guide element can be suitably assembled to the machine without disassembly of the thread feeding devices including the thread supply drums as such; or the stop-motion switches coupled to stop-motion sensing elements can be individually maintained or replaced.

24 Claims, 10 Drawing Figures

FIG. 2
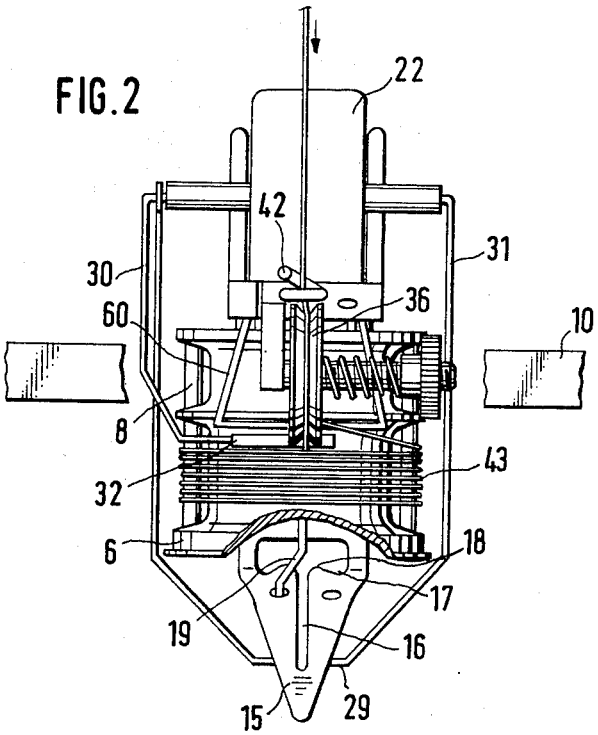
FIG. 4
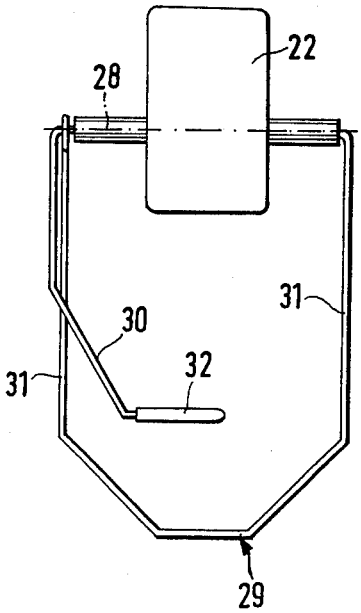
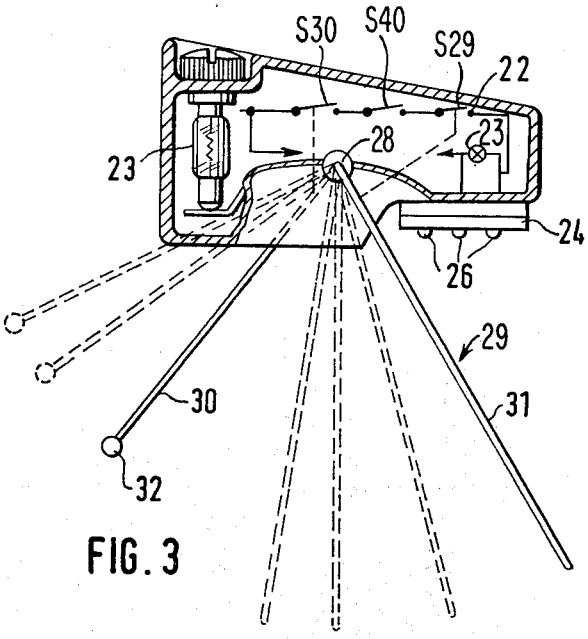
FIG. 3
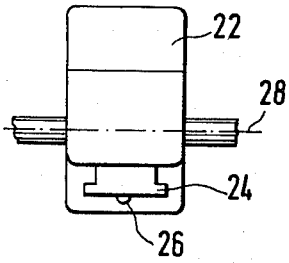
FIG. 5

RAPID MAINTENANCE THREAD OR YARN SUPPLY APPARATUS, PARTICULARLY FOR CIRCULAR KNITTING MACHINES

REFERENCE TO RELATED APPLICATION

U.S. Ser. No. 929,995, filed Aug. 1, 1978, MEMMINGER and Kuhn, "Thread or Yarn Supply Apparatus with Movable Thread Supply Guide Means, Particularly for Circular Knitting Machines".

U.S. patents, assigned to the assignee of the present application:

U.S. Pat. No. 4,028,911—Fecker et al

U.S. Pat. No. 4,047,398—Fecker et al

U.S. Pat. No. 4,056,239.—Fecker and Memminger

U.S. Ser. No. 827,966, now U.S. Pat. No. 4,114,823, Fecker and Memminger.

The present invention relates to a thread supply apparatus for circular knitting machines, and more particularly to a positive thread or yarn supply device arranged for assembly to a carrier ring of a circular knitting machine.

BACKGROUND AND PRIOR ART

Various types of thread supply devices are used with circular knitting machines. Usually, they include a storage drum which is rotatably journalled in a holder. The holder is removably secured to the knitting machine which, typically, is formed with a ring to which a plurality of such holders can be clamped, one for each knitting feed. Yarn is supplied to the respective drums of the yarn supply devices through supply guide means, to be there wrapped or looped about the drum to form a plurality of storage windings thereon. The thread is then pulled off the drum at a speed which may correspond to the wind-up speed and taken off through a take-off guide element, such as a guide eye or the like. Stop-motion devices which sense presence or absence of the thread and its tension, are usually associated with the storage drums to sense the thread being supplied to the drum as well as the thread being taken off. If the tension should fail, or if the thread should break, or if excessive tension should occur, for example because thread being supplied to the drum is not taken off smoothly from the supply yarn package, stop-motion signals are generated by the stop-motion devices to interrupt knitting operation of the machine. The machine will not, of course, stop immediately due to its inertia. The storage winding on the thread supply drums should be sufficient, that is, should have sufficient loops wrapped thereabout to permit the machine to continue to knit during the time taken to reach a full stop.

The thread presence or thread tension sensors associated with positive thread supply devices associated with circular knitting machines are of various types; usually, the thread or yarn sensors and the stop-motion devices are so arranged that they are secured to the holder which also forms the journal or bearing for the storage drum, or that they are part of the housing for the holder or for the storage drum. Other types of thread sensors, particularly the supply thread sensors, have been proposed which are separately secured to the knitting machine, for example on an attachment or on a portion of the carrier ring which is used to also secure the thread supply drums to the knitting machine, or located close to the holder rings or holder arrangement for the yarn packages which supply the thread or yarn to the knitting machine. The trailing or take-off thread sensors are usually secured directly to the holder for the drum, and the necessary electrical switches are retained in the housing thereof.

The thread sensing devices and the associated switches are comparatively delicate. If damage or malfunction occurred on any one of the thread sensors, it was necessary to remove the entire thread supply assembly from the machine for replacement with a properly operating unit and subsequent bench maintenance or repair. This requires not only removal of a thread supply element but, since it is part of the entire knitting machine drive mechanism, comparatively complex disassembly work involving portions of the entire thread supply system for the specific knitting feed. Disassembly work involves disengagement of the thread supply drum from a drive belt which also supplies the other thread supply drums for other knitting feeds; removal of the yarn from the defective thread supply device and rethreading; and resetting and readjusting of the new thread supply drum and the associated thread sensors. There is usually little space for access to the various thread supply drums and the presence of multiple threads adjacent the specific thread supply drum additionally interferes with ready replacement or disassembly.

Some types of yarns are of such characteristics that they are ill suited for cooperation with the normal stop-motion thread sensing devices. Slubbed or other types of yarns which do not present a generally smooth surface are sometimes supplied without passage of the yarn through a stop-motion sensing device associated directly with the yarn supply drum. The presence of stop-motion yarn feelers interferes with smooth pull-off of such threads and, to use the machine with thread or yarn of this type, it is then necessary to disassemble all the thread supply devices and replace them with thread supply apparatus which does not have the stop-motion thread feelers.

THE INVENTION

It is an object to provide a thread supply device which is independent of stop-motion sensing elements so that stop-motion devices and their thread sensors can be removed from the thread supply drums for maintenance or use of the machine with other yarns, without disturbing the thread supply drums themselves; and, generally, to permit ready maintenance work on the stop motion sensing devices, or replacement thereof without disturbing the thread path and the threads or yarns which are wound on the respective thread supply drums, or the alignment and positioning of the thread supply drums themselves.

Briefly, a housing is provided which is removably attached to the holder which secures the thread supply drum to the machine; at least one of the thread presence sensing means, and preferably both, that is, the leading as well as the trailing thread presence sensing means, are secured to the housing which, preferably, internally retains the switches which are operated by the stop-motion sensing elements. The housing is preferably so arranged that it can be engaged by a sliding motion on the holder, thereby firmly seating the housing on the holder and, simultaneously, engaging electrical contacts with a wiping action to connect the electrical circuit within the housing to machine contact buttons on the holder which can be connected into the electrical circuit of the machine, in accordance with standard procedure.

It is thus a simple matter to remove the housing and the thread sensors thereon from the holder if the thread sensors are not needed for a specific type of yarn, or indeed are undesirable; or for maintenance and repair of the sensing elements and the associated electrical network.

Current multi-feed circular knitting machines which have a high number of feeds, for example 36 or more, leave relatively little space for the thread of yarn supply devices. Access to the respective thread supply devices thus is severly impaired. The space requirements for the entire device can be reduced by making the width of the housing and/or of the holder equal to or less than the diameter of the storage drum, thereby facilitating access to the housing retaining the switches and the associated stop-motion thread sensing elements.

Thread or yarn being removed from yarn packages which, frequently, are cross-wound packages, is sometimes impaired by thread of one layer falling below that of the uppermost layer, so that, at certain positions, the thread will drag as it is being removed. Such drags, if grossly interfering with removal of thread from the yarn package, may lead to breakage of the thread. To prevent thread breakage, it has been proposed to guide the thread from the respective yarn package to a drag-compensating element which includes a stop-motion device which responds if the tension or pull or tug on the thread to pull it off the package, due e.g. to a mis-wound loop, causes breakage. Additionally, some further slack space is provided for the thread path. These additional pull-off stop-motion devices increase the complexity of the thread path, and the height or space requirements for the machine. These additional stop-motion devices can be eliminated if, in accordance with a preferred feature of the invention, the thread supply guide means, which include a thread brake, are pivotally or otherwise movably secured to the holder; preferably, the thread supply guide means are pivoted about an axis transverse to the operating axis of the thread supply drum and arranged to permit upward pivoting if the pull-off tension should become excessive; if, as would usually be the case, the thread then winds off the package normally, the thread supply means reverts to its normal position; in a limiting case, however, if the tension of the supplied thread exceeds a predetermined limit, the thread supply guide means will pivot about an angle greater than a predetermined value and cause the machine to stop. The tension of the thread brake, and the pivoting operation can be set, either by spring loading or by the weight of the thread supply guide device itself. Thus, some excessive thread tension can be absorbed or accepted at the inlet or supply to the thread supply drum without the stop-motion device responding. Pivoting of the thread supply guide element results in some compensation for the excessive tension occasioned by a mis-winding on the yarn package, thus preventing thread breakage and permitting normal feed, as soon as the specific mis-wound or drag zone has cleared.

Drawings, illustrating preferred embodiments, wherein:

FIG. 2 is a schematic front view, in which the forward part is partly cut away;

FIG. 3 is a schematic side view, partly cut open, of the additional separate housing-and-stop-motion assembly;

FIG. 4 is a front view of the housing and assembly of FIG. 3;

FIG. 5 is a rear view of the housing;

Figure 1:
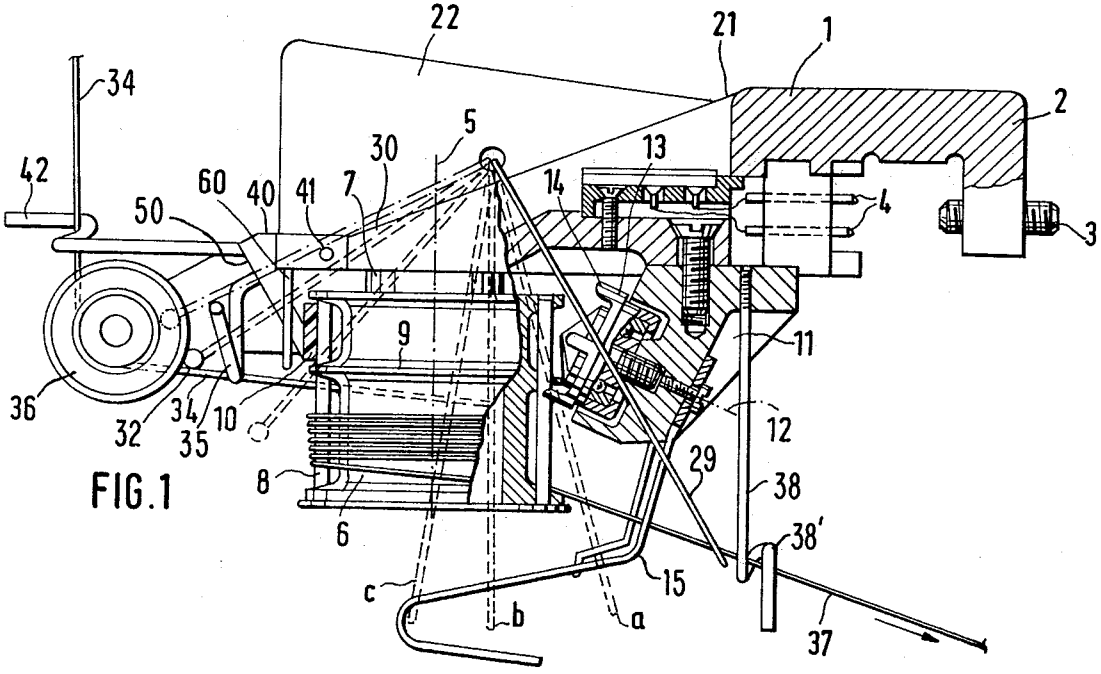
FIG. 1 is a schematic side view of the apparatus, omitting portions not necessary for an understanding of the invention, partly in section.

The thread supply device is secured to a knitting machine—not shown—by means of a flat bracket-like holder 1 which has one end formed like a hook to fit over a support ring on the knitting machine. The clamp bolt 3 is used to bolt the holder 1 to the ring of the knitting machine. Two contact prongs 4 project from the interior of the U-shaped bracket end of holder 1 to fit into similar sockets formed on the holding ring of the knitting machine. When the device is operative, electrical connection is made between the prongs 4 and the connecting socket on the ring which, in turn, is connected to a cable within the ring to conduct stop-motion signals to the machine. Two contact prongs are shown, although more can be used; the chassis or the frame of the machine may, itself, form one terminal of the signalling system.

A thread supply drum 6, freely rotatable about a vertical axis 5 (FIG. 1) is located at the bottom side of the holder 1. The supply drum 6 is journalled by means of a bearing, preferably a roller bearing or needle bearing (not shown) in a hub 7. The drum 6 is formed like a squirrel cage, that is, has a plurality of vertical rods 8 circumferentially located about the drum 6. The drum 6 is formed in two sections, subdivided by an intermediate separating bead 9.

The upper region of the drum 6 is used for engagement with a drive belt 10 which is internally serrated, or formed with teeth, to engage around the rods 8 of the drum 6. The belt 10 is driven from a main drive sprocket of the knitting machine (not shown), thereby rotating the drum 6 about its axis 5.

The holding arm 11 is secured laterally with respect to the drum which supports an end gear 13, having teeth which engage in the spaces between the rods 8 of the drum 6. The gear 13 is rotatable about an axis 12 which is inclined with respect to the axis of rotation 5 of the drum 6. Reference is made to U.S. Pat. Nos. 4,028,911 and 4,047,398 for a more detailed disclosure of such a system. A thread guide element 15 (see specifically FIG. 1) is located beneath the drum 6. This element may, for example, be a sheet metal guide which has a thread guide slit 16 directed towards the axis of rotation 5 of the drum 6. The end portion of the guide element 15 is enlarged and has an opening therein which defines a shoulder 18 (FIG. 2), communicating at the outside with two depressions 17. The arrangement of the shoulder 18 and the thread depression 17 is symmetrical with respect to the slit 16. One side of the opening can be blocked by a movable blocking ball 19. Reference is made to U.S. Ser. No. 827,966, now U.S. Pat. No. 4,114,823, Fecker and Memminger, assigned to the assignee of this application, for a more detailed disclosure of this thread guide arrangement.

In accordance with the present invention, a housing 22 is attached to an inclined surface 21 formed on the holder 1. The housing 22—see FIG. 3—holds the supply thread sensor 30, the removal or run-off thread sensor 29, and electrical contacts operated thereby, as well as an indicator lamp 23. Indicator lamp 23 is shown twice—once in its actual physical aspect, and once schematically within the circuit.

The housing 22 is formed with a shoe 24 which engages in a suitable socket 25 (FIG. 6) on the holder 1. The shoe 24 carries electrical terminals 26 so that, when the housing 22 with its shoe is engaged with the socket 25, fixed contacts 27 on the socket guide 25, will be engaged, to form a closed electrical connection. The shoe 24 and the socket 25, when engaged, are snapped or locked together; they can be removed by relative sliding movement. The contact buttons 26, for example, can be spring-loaded; the contact terminals 27 may also be spring-loaded, or may be formed by resiliently yielding depressions which permit snapping-in of contact buttons 26. The arrangement can be similar to the removable combination locking connection and electrical terminal found on flash attachments and many cameras, in which the shoe is formed with a groove in which in-turned edges of the socket fit to form a projection-recess interlocking arrangement, or similar to a dovetail fit.

Figure 6:
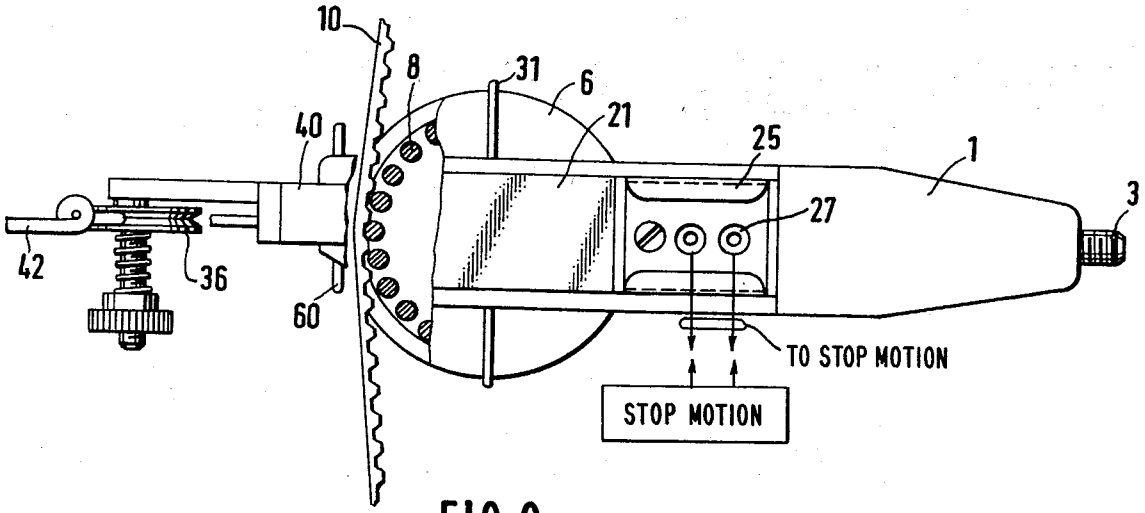
FIG. 6 is a top view of the holder and drum, partly cut away and sectionalized, with the housing and stop-motion devices removed.

The housing 22, which forms an additional or auxiliary or attachment element, carries two thread sensing arms. The leading or supply thread sensing arm 30 is L-shaped and has a flat portion 32 which is coated, or surrounded by an abrasion-resistant coating or cover. The run-off or pay-out sensing bail 29 is a generally U-shaped element with two lateral legs 31. Both thread sensors 30, 29 are pivotable about common axis 28 (FIG. 4). Arm 29 and the legs 31 thereof are placed adjacent drum 6, as best seen in FIGS. 2 and 6, to be freely movable about axis 28. The sensing end of arm 30, surrounded by abrasion-resistant material, preferably is flat.

Arms 29 and 30 are each connected to respective switches S29, S30, as schematically indicated in FIG. 3 by a broken line. The switches are serially connected and, in turn, are connected to two contact buttons 26. If thread supply is normal, the switches are closed. If the stop-motion of any one of the thread supply devices responds, the respective switch S29 or S30 will open, thus breaking the closed series circuit, causing lamp 23 to light since the short circuit effected by switches S29, S30 is removed.

Figure 7:
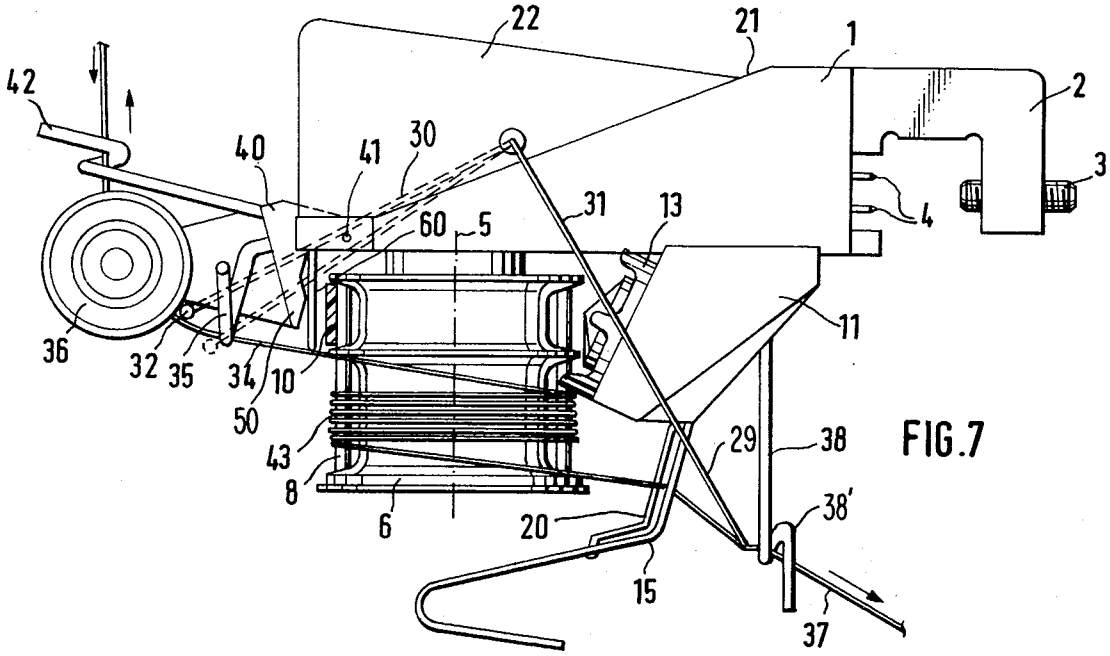
FIG. 7 is a view similar to FIG. 1 and illustrating the thread supply guide means partly pivoted.

The element 22, when assembled to the holder 1, is so arranged that the leading sensing arm 30 extends forwardly as best seen in FIG. 7, solid lines. The sensing portion 32 will ride on the supply thread 34 in the region between an inlet thread guide eye element 35 and a thread brake 36. The pay-out or run-out sensing arm 29 engages the pay-out thread 37 in the region between a pull-off or run-out eye 38' and the thread guide element 15. Eye 38' is formed at the end of a holder rod 38. The arm 30 can be locked in a position ineffective to sense presence of a thread by any well known means.

A thread supply guide portion 40 (not separately identified in FIG. 3) is attached to the housing 22. Portion 40 is pivotable about a horizontal axis 41, for example formed by a pivot pin (FIGS. 1, 7). The portion 40 carries the thread brake 36 and the inlet guide element 35. The portion 40, preferably, is formed as a flat rail. The portion 40 may be associated with an additional switch S40, like the switches S29, S30, and likewise serially connected in the circuit to provide a stop-motion signal if the portion 40 swings upwardly beyond a certain limit.

The supply thread 34, supplied from a yarn package (not shown) is guided through an inlet eye 42 on portion 40; through the thread brake 36, through the inlet eye 35, and then to the upper zone of the lower portion of drum 6. The thread will be wound upon the drum 6 forming a storage winding 43 (FIG. 7) thereon, in the form of a plurality of adjacently arranged loops or windings. The respective upper winding coacts with the gear 13, which forms the feed arrangement, so that the entire group of windings forming the storage winding 43 is continuously pushed downwardly in axial direction with respect to the drum.

Presence of the thread and its tension are sensed by the supply sensing arm 30, or its feeler end 32, respectively. If thread tension should fail, or the thread should break, the arm 30 will swing from the solid-line to the dotted-line position (FIG. 7), causing switch S30 (FIG. 3) to open. The stop-motion has responded.

The pulled-off thread 37, which is pulled off with the same speed as the supplied thread 34, is sensed by the pull-off feeler 29. As best seen in FIG. 7, the feeler arm 29 engages with its cross-connected portion on the thread 37. If the thread should break, or there should be loss of tension, the arm 31 will change from the position shown in FIG. 7 to the position shown in broken lines and indicated at a in FIG. 1. Again, the stop-motion will respond, and switch S29 will open.

The cross portion of stop-motion device 29 need not be straight as shown in FIGS. 2 and 4; it can be bowed slightly upwardly to assist in centering.

The arm 29 can pivot into the position b (FIG. 1) beneath the bottom surface of drum 6. In this position, arm 29 is approximately vertical. If no thread is consumed at a knitting feed, but the drum continues to rotate due to inertia, for example, the position at b prevents twisting and catching of the untensioned loose loop formed by the yarn or thread 37. A third position is possible; the arm 29 can be moved into the position c, at which point it can be locked, for example by catching against a projection, or by a swing lock located on the housing 22. The position c is used to permit pull-off of the yarn over the end surface of drum 6—see FIG. 9, which is used for intermittent feeding or, for example, upon adjustment or setting of the machine, or for demand feeding.

Figure 8:
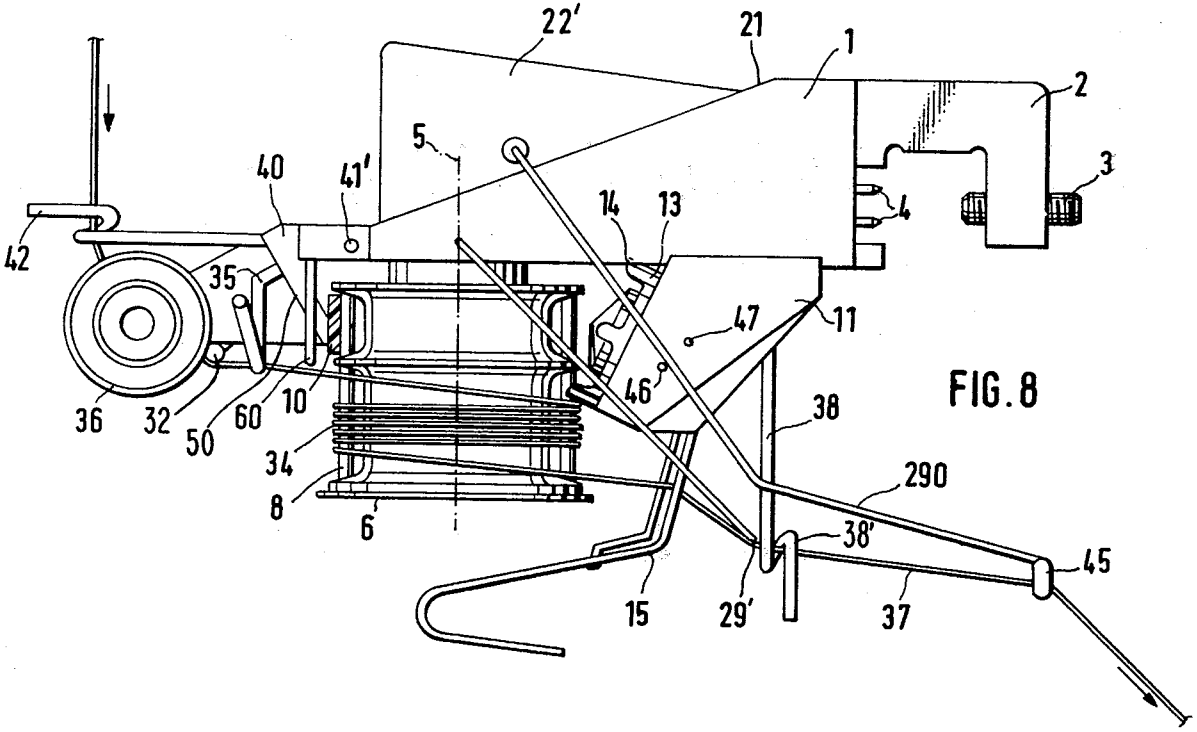
FIG. 8 is a side view similar to FIG. 1 and illustrating another embodiment.
Figure 9:
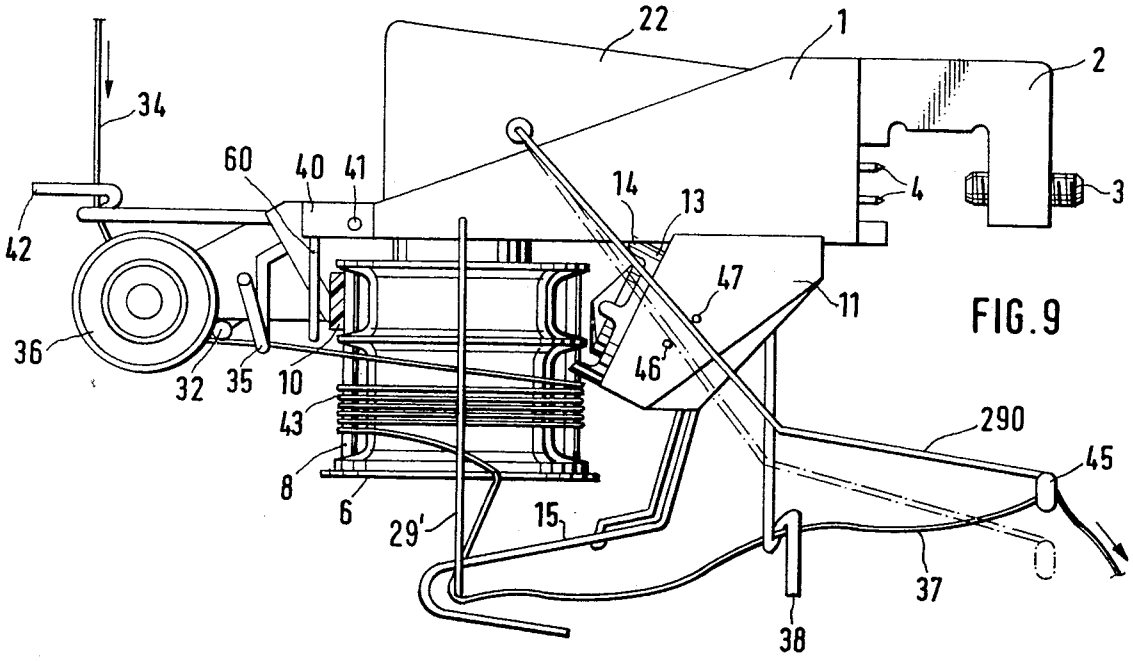
FIG. 9 is a side view of the embodiment of FIG. 8 set for intermittent or demand thread or yarn pull-off.

Embodiment of FIGS. 8–9: The portion 40, rather than being secured to the housing 22, is pivotally mounted on holder 1 by a shaft 41'. A thread guide eye 45 is located downstream—with respect to thread movement—of the pull-off eye 38'. Eye 45 is attached to an arm 290 which is pivoted to the housing 22' about an axis transverse to the axis of rotation 5 of the drum 6. The arm 290 can move between two stops 46, 47 formed on the projection 11 of holder 1. The arm 290, in one form, may be made of resilient material to permit yielding deflection thereof so that, under tension due to the pulled-off yarn 37, it can engage stop 46 and resiliently, yieldingly deflect downwardly, that is, in clockwise direction. Alternatively, arm 290 can be biassed to maintain the position shown in FIG. 8, yieldingly, by attachment of arm 290 about a spiral spring located, for example, within housing 22'. This spring would tend to move the arm 290 in counterclockwise direction—with respect to FIG. 8—that is, to move the arm 290 towards the stop 47. The arm 290 is then coupled to a stop-motion switch, similar to switch S29. The strength of such a spring (not shown) will be determined by whether the spring is merely to act as a restoring spring, or also to take over some of the functions of the stop 46.

It is a function of the arm 290 to provide a certain elastic deflection path for the thread guide element 45, so that the pulled-off thread 37 will include a thread reserve, necessary, for example, when knitting plush yarn, or when needle pull tension is desired.

The yarn pull-off sensing arm 29' engages the pulled off yarn 37 between the guide element 15 and pull-off eye element 38'.

In the embodiment of FIG. 8, the stop-motion arm 29' is pivotally attached to the holder 1 although, in a preferred form, it is pivotally mounted on the housing 22'. Since the eye 45 will have stop-motion functions, the arm 29' can be securely but adjustably attached to the holder 1, so that the arm 29' acts only as a thread guide element which, selectively, can be moved from the solid-line position shown in FIG. 8 to the positions b and c as shown in FIG. 1, and not coupled to any stop-motion device at all. The arm 29' is then only used to permit, selectively, intermittent yarn pull-off or positive feed.

FIG. 9 illustrates the position of arm 29' when used for demand feeding, as well as the path of thread 37 which results. FIG. 9 also illustrates arm 290 in operated, that is, stop-motion position, with the thread 37 being slack. Upon tensioning of the thread, arm 290 will move from the solid-line position (FIG. 9) to the chain-dotted position, which correspond to the solid-line position of FIG. 8.

Figure 10:
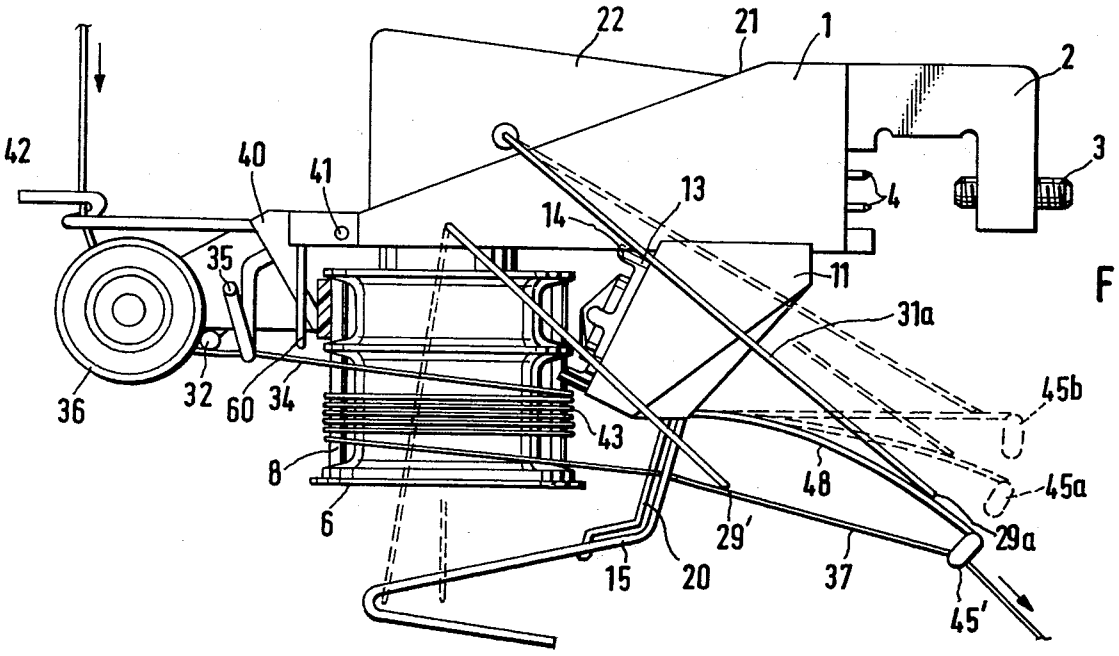
FIG. 10 is a side view similar to FIG. 1 of a third embodiment.

Embodiment of FIG. 10: A thread guide element 45' is located at the end of a spring 48 clamped to the projection 11. In ordinary operation, the spring 45 can move from the position shown in solid lines to the broken-line position indicated at **45*a*. Due to varying thread demand, the eye 45' will oscillate between these two positions. If thread tension should fail, however, spring 48 moves the element 45' in the position shown at 45*b*, which also causes the arm 29*a* to move upwardly and open switch S29. The position of spring 48 is sensed by the stop-motion bail 29*a* which, similar to the element 29 (FIG. 4), has two legs 31*a* and is similarly connected to housing 22. The arm 29' is pivotally located on holder 1 and is provided only to permit intermittent thread pull off, as shown in broken lines, or to be locked out of position, as also shown in broken lines in FIG. 10. Arm 29' can be pivoted on housing 22, but since it is not electrically connected to any terminals, locating it on holder 1 is a preferred position for this embodiment. Arm 30 has been omitted for clarity, and only thread engagement element 32 is shown in FIG. 10**.

The supply eye 35 and the pull-off eye 38 (not shown in FIG. 10, and not necessary for this embodiment) preferably are formed as axially offset "pigtail" eyes to facilitate threading.

The portion 40 is formed with a projecting bracket 50 which, when the portion 40 is in the position shown in FIGS. 1, 8, 9, 10, almost engages the outer surface of the belt 10. It is slightly spaced therefrom, the bracket 50 being provided to prevent undesired disengagement of the belt 10 from the drum 6 in case there should be loss of belt tension, which might occur upon maintenance work on a yarn supply device other than the one under consideration. If the belt 10 is to be released, the entire portion 40 is pivoted about its pivot axis; this then permits removal and disassembly of the drum 6 from the holder 1.

The run-out eye 38' is preferably yieldingly or resiliently secured to and, for example, may be attached to the projection 11, or to the holder 1, similar to the eye 45', that is, by a spring arm secured to the bracket 11.

The portion 40 at the supply side of the device is held in downwardly pivoted position by its own weight or, for example, by a spring (not shown) tending to hold the portion 40 in the position shown in FIG. 1. It can also be locked in fixed position, as schematically shown by arrow L, FIG. 8. If thread or yarn being pulled off from a yarn package is poorly wound, so that a loop on the yarn package will catch, causing a drag on the yarn, the portion 40, when unlocked, can pivot upwardly, that is, in clockwise direction about the pivot axis 41. Such an instantaneous increase in tension—which normally rapidly disappears—permits lifting of the entire portion 40 above the horizontal axis 41, thereby compensating for a sudden tug on the yarn or thread, and preventing breakage or tearing of the yarn. FIG. 7 illustrates the portion 40 lifted slightly.

An additional thread guide bail 60 is provided to hold the thread out of possible interference with the belt 10 if the portion 40 pivots upwardly. The thread hold-down bail, preferably, is U-shaped, or L-shaped, and secured to the holder 1. The attachment of bail 60 to holder 1 is not visible, being hidden behind portion 40. It can be fixed thereto, and need not be movably located. The thread hold-down bail 60 does not come in contact with the thread 34 during normal operation; only if the portion 40 should pivot upwardly, that is, clockwise (with respect to FIG. 1 or 7) will it be necessary to prevent upward swinging of the thread to hold it clear of the belt 10. The lower portion of the hold-down bail 40 is, roughly, at the level of the bead 9 of the drum, which separates the drive belt portion of the drum and the thread storage winding portion thereof. The distance of hold-down bail 60 from the bead 9 is just slightly greater than the thickness of the belt 10.

A tug operation causes the portion 40 to swing upwardly—see FIG. 7. If the upward pivoting movement exceeds a certain limit, for example if the thread path 34 changes to such an extent that the supply guide arm 30 reaches the chain-dotted position of FIG. 1, the machine will stop since the stop-motion switch S30 will be operated.

The device lends itself particularly to use with yarn of different characteristic than normally smooth filaments; upon removal of housing 22, a thread brake, not shown, and designed specifically for the type of yarn to be employed, can be mounted on the socket 25, omitting the thread brake 36 and portion 40 entirely. Other units can be used—for example housing 22 on which the portion 40 is pivoted (FIG. 1) or on which such portions have been omitted, with no similar portion being secured to the holder 1. The versatility of the thread supply is thus substantially improved, permitting rapid change-over of the machine without, however, requiring the disassembly and replacement of the entire thread supply devices; it is only necessary to disengage the slide-in shoe-socket connection of housing 22, and associated elements, with a different housing, having the appropriate elements thereon.

Other arrangements than the photographic-type shoe-socket interconnections may be used, although this simple and reliable connection is preferred.

The pull-off sensing arm 29, which merely rides on the thread by its own weight, adds hardly any tension to the pull-off tension on the thread. The weight of such an arm is small and the engaging element can be made smooth and abrasion-resistant; thus, minimum tension is added by the stop-motion system, permitting the use of sensitive and delicate contacts which, however, may need periodic maintenance. This periodic maintenance is greatly facilitated by the aforementioned socket-shoe connection. The thread itself is supported both in advance as well as behind the sensing arm 29—by the guide element 15 and the pull-off eye 38' to additionally improve the reliability of operation of the arm 29 and the associated stop-motion switch.

The electrical connection is so made that the stop-motion device is disabled when the sensing elements 29 and 30 are in their normal position. Additionally, the stop-motion device is disabled when the sensing device 29 is moved to the c position of FIG. 1, to permit adjustment and set-up of the machine without response by the stop-motion devices; or a manual override can be provided.

The supply guide portion 40 need not be pivotally located or, if so located, can be arranged to be locked in position, for example the normal position shown in FIGS. 1, 8–10. In a preferred form, the portion 40 can be positively pivoted upwardly, which greatly facilitates threading of the yarn and set-up of the machine and the yarn guide devices. Thereafter, and when ready to start, the portion 40 is placed in the normal position and can be locked, for example by a hold-down clamp, or the like, or a push-spring slidable over the portion 40, particularly if misfeeds from the yarn packages are not expected.

Various other changes and modifications may be made, and features described in connection with any one of the embodiments may be used with any of the others, within the scope of the inventive concept.

We claim:

1. Rapid-maintenance thread or yarn supply apparatus, particularly for a circular knitting machine having a holder (1) having a rear portion (2, 3) adapted for assembly to the machine;

a thread supply drum (6) rotatably journalled on the holder;

thread supply guide means (35, 36, 42) having, in operation of the machine, a predetermined position relative to the axis of rotation of the drum and guiding the thread in a supply guide path to the drum to wind a storage winding (43) thereon;

thread take-off guide means (15, 38, 291) having, in operation of the machine, a predetermined position relative to the axis of rotation of the drum and guiding thread being taken off the drum in a take-off guide path;

movable leading thread presence sensing means (30, 32) located in the supply guide path of the thread and in advance of the storage drum to sense presence and tension of thread (34) being supplied to the drum;

movable trailing thread presence sensing means (29, 290) located in the take-off guide path of the thread and downstream of the storage drum to sense presence and tension of thread (37) being taken off the drum;

a housing (22) removably attached to a front portion of the holder (1) to which both the leading thread presence sensing means (30, 32) and the trailing thread presence sensing means (29, 290) are secured;

a thread supply portion (40) forming at least part of said thread guide means, pivotally secured to the housing and pivotable about a pivot axis (41) transverse to the axis of rotation of the drum, and including a thread drag sensing means (36);

switch means (S29, S30, S40) located in said housing, operated by the respective thread presence sensing means and the thread drag sensing means;

separable and engageable connecting contact means located, respectively, on said housing and on the holder;

and relatively slidable interengaging means (24, 25) on the holder, and on the housing, respectively, to removably secure the housing, and with it said thread sensing means, said drag sensing means, and said switch means to the holder and electrically connect the switch means to a stop motion circuit connection in the holder for connection to the step motion system of the machine;

to permit separate removal of the housing and with it the thread presence and drag sensing means without disassembly of the holder (1) and the drum (6) journalled therein from the machine.

2. Apparatus according to claim 1, wherein the slidable interengaging means (24, 25) comprises a tongue-and-groove connection.

3. Apparatus according to claim 1, wherein the trailing thread presence sensing means (29) comprises a movable sensing arm (29) acting on the thread (37) being taken off the drum in the region of the thread path between the take-off guide means (38) and the edge of the drum.

4. Apparatus according to claim 1, wherein (FIGS. 8, 9) the trailing thread presence sensing means (290) comprises a movable sensing arm (290) positioned to engage the thread (27) being taken off the drum in the region beyond the thread take-off guide means (38).

5. Apparatus according to claim 1, wherein the trailing thread presence sensing means (29, 290) comprises an arm and an engagement portion riding on the thread (37) being taken off the drum.

6. Apparatus according to claim 1, wherein the trailing thread presence sensing means (29) comprises a sensing arm (29) engaging the thread (27) being taken off the drum;

the thread take-off guide means comprises two thread take-off guide elements (15, 38), spaced from each other and determining the take-off thread guide path from the drum;

and the trailing thread presence sensing means (29) acts on the thread between said take-off guide elements (15, 38).

7. Apparatus according to claim 1, wherein the respective thread presence sensing means (29, 290; 30, 32, 29*a*) comprises a sensing arm which is pivotably secured to the housing (22) to pivot about an axis transverse to the axis of rotation (5) of the storage drum (6).

8. Apparatus according to claim 7, wherein the trailing thread presence sensing means (29) is movable about its pivot axis to a position beneath the bottom surface of the drum (6).

9. Apparatus according to claim 1, wherein the leading thread presence sensing means (30, 32) comprises a movable arm (30) engaging the thread (34) in a region between the thread drag sensing means brake (36) and the drum (6).

10. Apparatus according to claim 9, wherein the movable arm (30) of the leading thread sensing means is lackable positionable to a position ineffective to sense presence of a thread.

11. Apparatus according to claim 1, wherein the trailing thread presence sensing means (29) comprises a bail engageable with the thread;

and the bail of said thread presence sensing means is movable to engage the thread in a position between the thread take-off guide means (38) and the drum as well as to a position beneath the bottom of the drum to additionally guide the thread being taken off the drum over the end surface thereof.

12. Apparatus according to claim 1, wherein the width of the housing (22) and the width of the holder (1) are less than, or at most equal to the diameter of the drum (6).

13. Apparatus according to claim 1, wherein the thread take-off guide means is resiliently secured to the housing (22).

14. Apparatus according to claim 1, wherein the supply portion is biassed counter the tension exerted by the thread (34) being guided to the drum.

15. Apparatus according to claim 1, wherein the thread supply portion (40) is lockable in fixed position with respect to the thread supply drum.

16. Apparatus according to claim 1, wherein the thread drag sensing means comprises a thread brake (36) forming part of said thread supply guide means.

17. Apparatus according to claim 1, wherein the thread supply drum has a portion engageable by a drive belt (10) separate from the portion on which the thread storage winding (43) is wound;

and a belt holder and guide element (50) secured to the supply portion (40) and positioned opposite said belt to retain said belt on the portion of the drum assigned thereto and remote from the portion assigned to the storage winding (43).

18. Apparatus according to claim 17, further including a thread hold-down guide element (60) located in the path of the thread between the thread supply guide means and the drum and positioned to extend beyond the region of the drum engaged by the belt (10) to prevent interference of the thread being supplied to the drum with the belt.

19. For combination with a thread or yarn supply apparatus, particularly for a circular knitting machine, having a holder (1) for assembly to the knitting machine;

a thread supply drum (6) rotatably journalled on the holder (1), a thread supply guide means (35, 42) guiding the thread in a thread supply path to the drum to wind a storage winding (43) thereon; and a thread take-off guide means (15, 38, 29') guiding thread being taken off the drum in a thread take-off path;

a rapid maintenance attachment comprising separable means (22) removably attachable to the holder (1), said separable means having secured thereto a thread brake (36) pivotally secured to said attachment and pivotable about a pivot axis (41) transverse to the axis of rotation (5) of the drum, and including switch means (S40) operable upon pivoting movement of said thread brake (36) upon pivoting movement beyond a certain limit;

leading thread presence sensing means (30, 32) located in advance of the storage drum, when the attachment is assembled to the holder, to sense presence and tension of the thread being supplied to the drum in the thread supply path and including switch means (S30) operated by said leading thread presence sensing means;

trailing thread presence sensing means (29, 290) located downstream of the storage drum, when the attachment is secured to the holder, to sense presence and tension of thread (37) being taken off the drum in the thread take-off path and including switch means (S29) operated by said trailing thread presence sensing means;

wherein the holder and the rapid maintenance attachment are formed with mutually interengaging sliding separable connection means (24, 25) to separably but firmly connect the holder and said attachment together;

and separable connecting contact means (26, 27) respectively located on said attachment and on the holder and positioned for separable engagement upon interconnection of said attachment and the holder, the connecting contact means (26) on the attachment being in electrical circuit connection with said switch means (S29, S30, S40).

20. Attachment according to claim 19, wherein the sliding connection means comprises interengaging sliding tongue-groove connection means secured to said separable means for engagement with matching connection means formed on said holder, respectively, to slidably and removably connect said attachment and said holder together.

21. Attachment according to claim 19, wherein the width of said holder, and of said attachment, respectively, is less than or at most equal to the diameter of the drum.

22. Attachment according to claim 19, wherein the leading thread presence sensing means, the trailing thread presence sensing means, and the thread brake form separately movable means in engagement with the thread;

and the separable means comprise a holder base (22) and said separately movable means, as a unitary assembly, separable from said holder (1).

23. Rapid-maintenance thread or yarn supply apparatus, particularly for a circular knitting machine, having a holder (1) having a rear portion (2, 3) adapted for assembly to the machine;

a thread supply drum (6) rotatably journalled on the holder;

thread supply guide means (35, 36, 42) having, in operation of the machine, a predetermined position relative to the axis of rotation of the drum and guiding the thread in a supply guide path to the drum to wind the storage winding (43) thereon;

thread take-off guide means (15, 38, 291) having, in operation of the machine, a predetermined position relative to the axis of rotation of the drum and guiding thread being taken off the drum in a take-off guide path;

movable leading thread presence sensing means (30, 32) located in the supply guide path of the thread and in advance of the storage drum to sense presence and tension of thread (34) being supplied to the drum;

movable trailing thread presence sensing means (29, 290) located in the take-off guide path of the thread and downstream of the storage drum to sense presence and tension of thread (37) being taken off the drum;

a thread supply portion (40) including a thread guide eye (42) forming part of said thread supply guide means, said supply portion being movably secured to said housing and movable in the path of the thread from a supply to the drum (6);

a housing (22) removably attached to the front portion of the holder (1) to which at least one of said movable thread presence sensing means (30, 32; 29, 290) is secured to permit separate removal of the housing and with it the respective thread presence sensing means without disassembly of the holder (1) and the drum (6) journalled therein from the machine;

a belt holder and guide element (50) secured to the supply portion (40) and positioned opposite a drive belt (10) engageable with the thread supply drum (6);

and wherein the thread supply drum has a first portion engageable by said drive belt (10) and a second portion separate from said first portion on which the thread storage winding (43) is wound, said belt holder and guide element retaining said belt on the first portion of the drum which is assigned to said belt and remote from the second portion assigned to the storage winding (43)

24. Apparatus according to claim 23, further including a thread hold-down guide element (60) located in the path of the thread between the thread supply guide means and the drum and positioned to extend beyond the region of the drum engaged by the belt (10) to prevent interference of the thread being supplied to the drum with the belt.

* * * * *